US005767823A

United States Patent [19]

Hush

[11] Patent Number: 5,767,823

[45] Date of Patent: Jun. 16, 1998

[54] METHOD AND APPARATUS FOR GRAY SCALE MODULATION OF A MATRIX DISPLAY

[75] Inventor: Glen E. Hush, Boise, Id.

[73] Assignee: Micron Display, Inc., Boise, Id.

[21] Appl. No.: 539,670

[22] Filed: Oct. 5, 1995

[51] Int. Cl.[6] ..... G09G 3/36

[52] U.S. Cl. ..... 345/55; 345/89; 345/90; 345/100

[58] Field of Search ..... 345/58, 73, 63, 345/90, 74, 89, 88, 55, 92, 94, 60, 76, 98, 100; 358/11

[56] References Cited

U.S. PATENT DOCUMENTS

| | | | |
|---|---|---|---|
| 3,955,211 | 5/1976 | Peltier et al. | 358/11 |
| 4,427,978 | 1/1984 | Williams | 345/89 |
| 4,554,539 | 11/1985 | Graves | 345/76 |
| 4,771,278 | 9/1988 | Pooley | 345/73 |
| 5,036,317 | 7/1991 | Buzak | 345/74 |
| 5,436,635 | 7/1995 | Takahara et al. | 345/90 |
| 5,485,293 | 1/1996 | Robinder | 345/88 |
| 5,625,373 | 4/1997 | Johnson | 345/58 |

FOREIGN PATENT DOCUMENTS

| | | |
|---|---|---|
| 0 349 415 | 1/1990 | European Pat. Off. . |
| 0 660 367 | 6/1995 | European Pat. Off. . |
| 44 27 673 | 2/1995 | Germany . |

*Primary Examiner*—Steven Saras
*Assistant Examiner*—John Suraci
*Attorney, Agent, or Firm*—Seed and Berry LLP

[57] ABSTRACT

Gray scale modulation of a field emission display is provided by sampling the video data portion of an NTSC signal to obtain a plurality of samples corresponding in time to the position of the emitters in each row of the display. The samples are used to generate respective pulses having a width corresponding to the magnitudes of the samples. The pulses drive the respective emitters low during the horizontal retrace portion of the NTSC signal. The extraction grids in a selected row are driven high during the horizontal retrace portion to cause the emitter in the selected row and column to emit electrons. The extraction grids in the selected row are then driven low at the end of the horizontal retrace period to terminate the emission of electrons.

16 Claims, 8 Drawing Sheets

METHOD AND APPARATUS FOR GRAY SCALE MODULATION OF A MATRIX DISPLAY

This invention was made with government support under Contract No. DABT63-93-C-0025 awarded by Advanced Research Projects Agency (ARPA). The Government has certain rights in this invention.

TECHNICAL FIELD

This invention relates to matrix displays, and more particularly to a method and apparatus for providing gray scale control of a matrix display from a video signal.

BACKGROUND OF THE INVENTION

Until recently, the cathode ray tube ("CRT") has been the primary device for displaying video information. While having sufficient color, brightness, contrast and resolution characteristics, CRT's are relatively bulky, heavy and power consumptive. These failings, in view of the advent of portable laptop computers, portable televisions and monitors, view finders for video camcorders and other, compact, lightweight electronic devices has intensified the demand for a display which is lightweight, compact and power efficient.

One available technology for providing a lightweight and compact display are flat panel liquid crystal display ("LCD") devices. LCD's are currently used for laptop computers. However, conventional LCD devices provide relatively poor display characteristics in comparison to CRT technology. Moreover, color LCD devices consume power at excessive rates and they are far more costly than equivalent CRTs.

In view of the shortcomings of conventional CRTs and LCDs, some of which are described above, field emission displays ("FED") have been developed. FEDs utilize an array of pointed, thin film, cold field emission emitters in combination with a phosphor coated anode forming a luminescent screen. The flow of electrons from the emitter to the anode is typically controlled by an extraction grid surrounding each emitter. The differential voltage between the emitter and extraction grid is controlled to switch on and off the flow of electrons from the emitter to the anode screen and hence the illumination of a pixel or portion thereof.

In order to achieve the performance capabilities of CRTs, the intensity of light emitted by the phosphor luminescent screen must have a substantial dynamic range to provide a "gray scale" or "brightness" range. Several techniques have been proposed to provide this function. For example, U.S. Pat. No. 5,103,144 to Dunham and U.S. Pat. No. 5,103,145 to Doran disclose methods for controlling the brightness and luminance of flat panel displays.

One type of signal that is commonly applied to CRTs and other video displays is specified by the National Television Standards Committee and is known as an "NTSC signal." Each line of an NTSC signal consists of two signals, namely a video signal and a horizontal retrace signal. The video signal is an analog signal having a duration of 53.2 microseconds. The amplitude of the video signal at any point in time corresponds to the intensity of a point or pixel along a row of the video display. Thus, for example, the initial portion of the video signal provides an indication of the intensity of the display at the left end of a row, the center of the video signal corresponds to the intensity of the display at the middle of the row, and the end of the video signal provides an indication of the intensity of the display at the right end of the row. The horizontal retrace signal immediately follows the video signal, and includes a downwardly extending pulse that causes the video display to reset to the start of a subsequent row. Video displays typically consist of a large number of rows, such as 525 lines or rows.

One approach to gray scale control of a field emission display receiving an NTSC signal is disclosed in pending application Ser. No. 08/060,111 to Hush et al. As illustrated in FIG. 1, a field emission display 10 includes an array of cold cathode emitters 30–38. The emitters 30–38 in each column 50–58, respectively, are interconnected with each other so that they each receive the same voltage. Thus, for example, the emitters 32*a–e* in column 52 are connected to each other.

The field emission display 10 also includes an array of extraction grids 40–48 arranged in a manner similar to that of the emitters 30–38. Specifically, the extraction grids 40–48 in each row 60–68, respectively, are interconnected with each other so that they each receive the same voltage. Thus, for example, the extraction grids 42*a–e* in row 62 are connected to each other.

The field emission display 10 also includes a conductive, cathodoluminescent display screen (not shown in FIG. 1), to which a large positive voltage is applied so that the screen serves as an anode. In operation, appropriate voltages are applied to the emitters 30–38 and the extraction grids 40–48 to cause the emitters 30–38 to emit electrons. The emitted electrons are then drawn to the cathodoluminescent screen where they cause the emission of visible light at the locations that the electrons strike the screen. In one embodiment, the emitters 30–38 emit electrons whenever the differential voltage between the emitter 30–38 and its adjacent extraction grid 40–48 is greater than a turn-on threshold voltage between 40 and 80 volts. In this embodiment, electrons are emitted from a specific emitter 30–38 by grounding the column 50–58 containing that emitter 30–38 and driving the row 60–68 containing adjacent extraction grid 40–48. For example, electrons are emitted from the emitter 32*b* by grounding the column 52 and by driving the row 62 to 80 volts. A voltage substantially larger than zero volts (e.g., 40 volts) is placed on the remaining columns 50 and 54–58, and a voltage substantially smaller than 80 volts (e.g., 40 volts) is placed on the remaining rows 60 and 64–68. Thus, the emitter/grid voltage differential for the selected emitter 32*b* and grid 42*b* is 80 volts, the voltage differential for all other emitters 32*a* and 32*c–e* in the selected column 52 and grids 42*a* and 42*c–e* in the selected row 62 is *40* volts, and the voltage differential for all other emitters 30 and 34–38 and grids 40 and 44–48 zero volts. Under these circumstances, only the emitter 32*b* emits electrons to produce visible light on the cathodoluminescent screen adjacent the emitter 32*b*.

The approach to gray scale control of a field emission display described in the Hush et al. application is illustrated in FIG. 2. The NTSC video signal is applied to a pulse width converter 70 which first obtains a plurality of samples corresponding to the intensity of respective locations along a row of the display, and then converts each of the samples to a corresponding pulse width. A pulse width signal 72 generated by the pulse width converter 70 is then applied to an emitter control circuit 76 for an emitter located at a position corresponding to the time at which the sample was taken. The pulse width signal 72 then switches an NMOS transistor 80 to connect the cathode 30 to ground through a resistor 82 in a previously enabled NMOS transistor 84. The voltage on the emitter 30 then drops from its quiescent level of about 40 volts to a lower voltage. Since the extraction grid 40 is maintained at 80 volts, there is now a differential voltage between the extraction grid 40 and the emitter 30 that is sufficient to cause the emitter 30 to emit electrons. Under these circumstances, electrons flow from the emitter 30 to an anode 90 which is maintained at 1,000 volts. Thus, the approach described in the Hush et al. application and shown in FIG. 2 causes current to flow from the emitter 30 to the anode 90 for a duration corresponding to the amplitude of the video signal at a point in time corresponding to the location of the emitter 30.

While the approach described in the Hush et al. Application represents a significant improvement over the prior art, it is impractical for use in a passive matrix field emission display. In an active matrix field emission display, switching transistors for the emitters and/or extraction grid are formed on the substrate of the display. Therefore, the switching voltages can be relatively small. These relatively small voltages can be switched at a sufficient speed to keep up with the data rate of the NTSC signal in real time. However, relatively large switching voltages must be applied to a passive matrix field emission display. It is generally not possible to switch these relatively large voltages at a sufficient speed to keep up with the data rate of an NTSC signal in real time. Not only must the display circuitry switch these high voltages hundreds of times during the 53.2 microseconds over which the data portion of the NTSC signal occurs, but the gray scale control circuitry must provide hundreds of samples, convert those samples to corresponding pulse widths, and apply those pulse to corresponding emitters. It is difficult to quickly switch voltages on the emitters and extraction grids, particularly using relatively little circuitry (which is desired to minimize power and make the control circuitry compact), because of the nature of the load formed by the emitters and extraction grid. The basic problem is that the emitters and extraction grids are essentially capacitive loads which require a relatively low impedance voltage source to switch voltages at a rapid rate. With reference to FIG. 3A, for example, an emitter represented by capacitor 100 is biased to a relatively high voltage +V through resistor 102, and switched to ground by an NMOS transistor 104. It is desirable to NMOS transistors because NMOS transistors use significantly less space than PMOS transistors, thus allowing the control circuitry to be relatively compact. The need to minimize semiconductive fabrication area is exacerbated by the relatively large voltages being switched which require relatively large spacing between transistor channels. The switching circuit shown in FIG. 3A is capable of switching the voltage from high to low at a rapid rate, as shown in the adjacent wave form diagram of FIG. 3B because the NMOS transistor 104 provides a relatively low impedance path to ground. However, the time required for the capacitor 100 to recharge through the resistor 102 is substantially longer and would prevent the switching circuit from switching emitters at a sufficiently rapid rate. The low to high transition time could be reduced by using a significantly smaller resistor 102. However, doing so would greatly increase the power consumption since the relatively low value resistor 102 would then be connected directly to ground when the transistor 104 was switched on.

A similar problem exists in using a PMOS transistor to switch the extraction grids or emitters, as shown in FIG. 4. With reference to FIG. 4A, the capacitor 100 (representing an emitter) is biased to ground through a resistor 106. The capacitor 100 is switched to a relatively high voltage by a PMOS transistor 108. As shown by the wave form diagram of FIG. 4B, the transistor 108 is capable of switching the voltage on the capacitor 100 to a relatively high voltage at a rapid rate. However, the capacitor 100 is discharged through the resistor 106 at a relatively low rate. Once again, the high to low transition of the voltage on the capacitor 100 could be reduced by using a significantly smaller resistor 106. However, doing so would greatly increase the power consumption.

One approach to switching the voltage on emitters and extraction grids between high and low values at a relatively rapid rate is illustrated in FIG. 5. As shown therein, the capacitor 100 (representing an emitter) is connected to a switching circuit 110 consisting of a PMOS transistor 112 and an NMOS transistor 114 having their drains connected to each other and to the capacitor 100. A high to low transition of a control input 116 turns off transistor 114 and turns on transistor 112 thereby connecting the capacitor 100 to a supply voltage $V_{DD}$ through a relatively low impedance. As a result, the low to high transition of the voltage on the capacitor is relatively fast. A low to high transition of a control input 116 to the switching circuit 110 turns off the PMOS transistor 112 and turns on the NMOS transistor 114, thereby connecting the capacitor 100 to ground through a relatively low impedance. As a result, the high to low transition of the voltage on the capacitor 100 is also relatively fast. Although the switching circuit 110 shown in FIG. 5 may allow a gray scale control for a field emitter display to keep up with an NTSC signal, it uses a relatively large amount of power and consumes a relatively large area of a semiconductor substrate. Not only does a low impedance PMOS transistor consume relatively large amount of semiconductor substrate area, but it also requires additional masking steps during fabrication thereby increasing fabrications costs and reducing yields.

SUMMARY OF THE INVENTION

The inventive method and apparatus is able to overcome the limitations of the conventional approaches by sampling a video signal to obtain a plurality of samples corresponding to the amplitude of the video signal at respective sample times. The samples thus correspond to respective locations of emitters in a row of the field emission display. The samples are then converted to corresponding pulse widths. However, rather than attempting to process the pulse width signals in real time, the pulse width signals modulate the differential voltage between each of the emitters and its respective extraction grid at a later time, such as during the horizontal retrace portion of an NTSC signal. Thus, the only function that must occur in real time is the sampling of the video signal. Thereafter, all of the samples can be processed at the same time during a subsequent portion of the video signal, such as during the horizontal retrace portion of an NTSC signal. In accordance with one aspect of the invention, the differential voltage between each of the emitters and its respective extraction grid is maintained at a relatively low voltage (sufficiently low that there is no electron emission) by maintaining the voltage on the emitter and the voltage on the extraction grid at respective, relatively high voltages at the end of the video signal. The voltage on the emitter is then driven to a relatively low voltage a first predetermined time after the end of the video signal. Since the voltage on the emitter is now significantly lower than the voltage on the extraction grid, electrons flow from the emitter to the anode. The voltage on the extraction grid is subsequently driven to a relatively low voltage a second predetermined time after the end of the video signal, thereby terminating the flow of electrons from the emitter to the anode. The duration of the period between the first predetermined time and the second predetermined time (during which electrons flow from the emitter to the anode) is a function of the duration of the pulse width. The advantage of this approach is that the voltage transitions determining the "on" period of the emitter are both high to low transitions which can be accomplished easily by reac-complished easily by relatively compact NMOS transistors. The voltages on the emitter and extraction grid are then allowed to return to their respective relatively high voltages during the video signal for a subsequent row of emitters. The differential voltage between the emitter and the extraction grid during this period is sufficiently small to prevent the flow of electrons from the emitter to the anode. Significantly, the low to high transition of the voltages on the emitter and extraction grid need not be rapid since the transition need not be completed until after the end of the next video signal.

Although the inventive method and apparatus is preferably implemented by driving the emitters and extraction grids low to control the "on" times of the emitters, it may also be implemented by driving the emitters and extraction grids high to define the "on" time. In accordance with this aspect of the invention, the voltage on the extraction grid is driven to a relatively high voltage a first predetermined time after the end of the video signal. The voltage on the emitter is maintained at a relatively low voltage after the end of the video signal, thereby causing electrons to flow from the emitter to the anode after the first predetermined time. The voltage on the emitter is then driven to a relatively high voltage a second predetermined time after the end of the video signal, thereby terminating the flow of electrons from the emitter to the anode. The duration of the period between the first predetermined time and the second predetermined time is a function of the duration of the pulse width. The voltages on the emitter and the extraction grid are then allowed to return to respective, relatively low voltages during the video signal for a subsequent row. As before, the reset time during which the voltages return to their relatively low values is not critical.

In the event that more time is needed to process a sample and allow the voltages to reset, the video signal can be processed in an interleaved manner. In accordance with this aspect of the invention, alternate video signals are sampled to provide a plurality of samples corresponding to respective locations of emitters in alternate rows. The differential voltage between the emitters and its respective extraction grid is then modulated for alternate columns during a period that may encompass the next two video data signals.

DETAILED DESCRIPTION OF THE INVENTION

Figure 6:
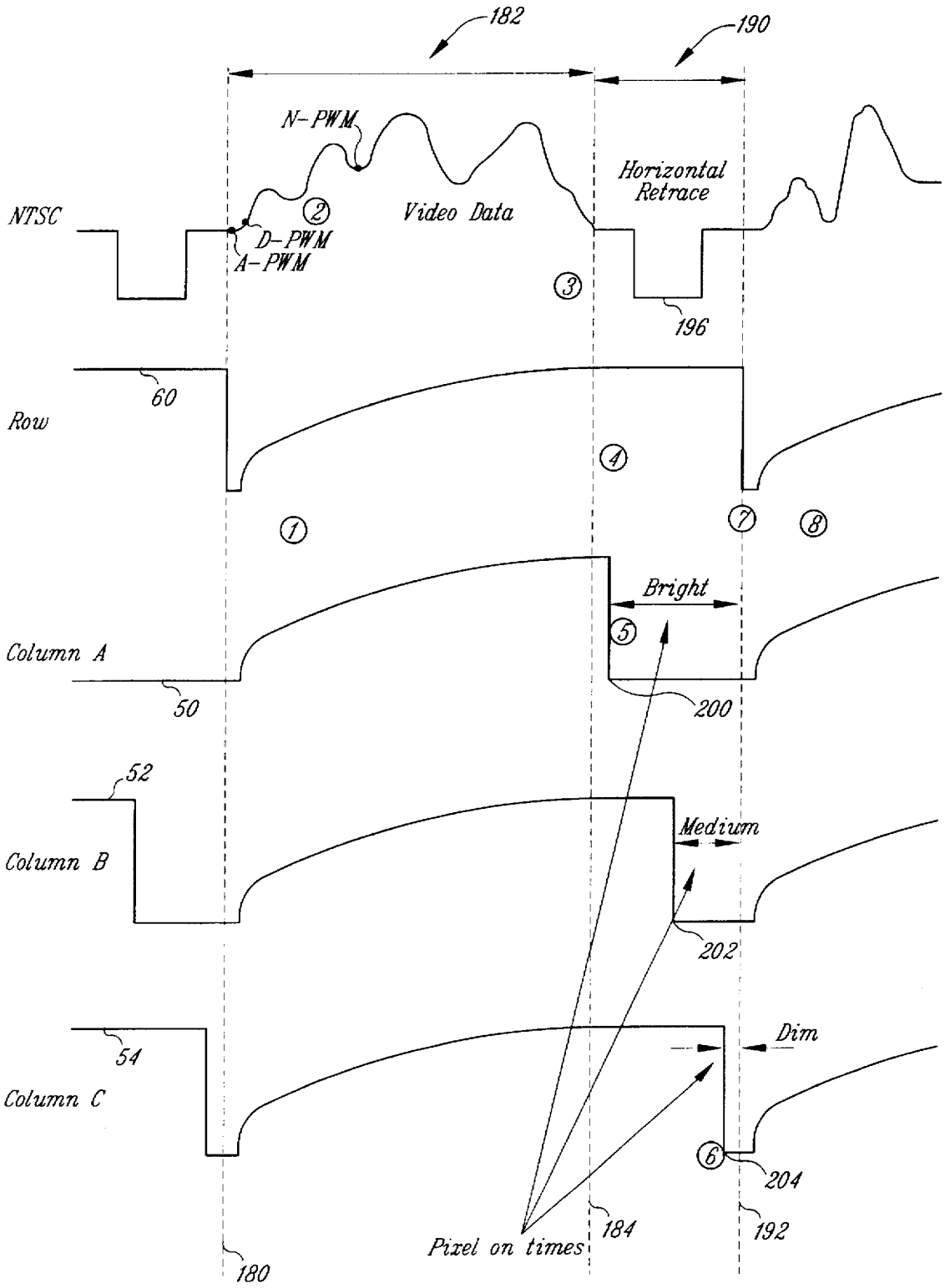
FIG. 6 is a wave form diagram illustrating the presently preferred embodiment of the inventive technique for providing gray scale modulation of a field emitter display.

The theory of operation of the presently preferred embodiment of the invention is illustrated in FIG. 6. Although the preferred embodiment is explained with reference to an NTSC signal composed, at least in part, by a video signal and a horizontal retrace signal, it will be understood that the invention is applicable to other types of video signals, such as well known PAC and SECAM signal formats.

Figure 2:
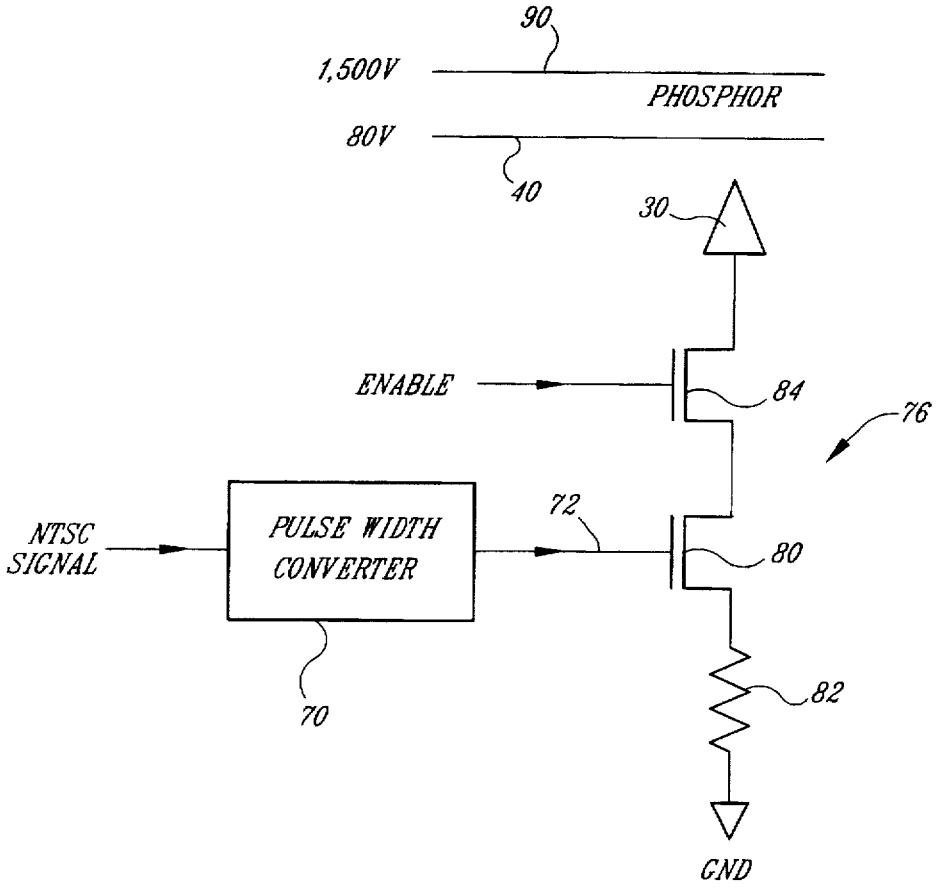
FIG. 2 is a block diagram of an existing approach to providing gray scale modulation of a field emitter display.
Figure 3A:
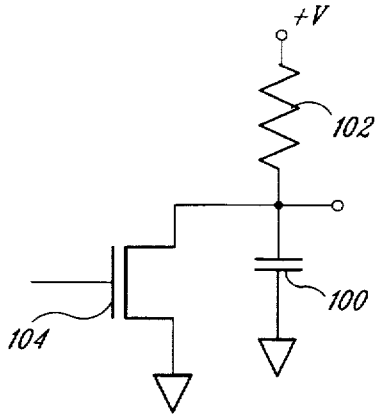
FIGS. 3A and 3B are a schematic and a waveform diagram, respectively, showing a prior art approach to switching the voltages on the emitters and extraction grids of conventional field emitter displays.
Figure 3B:
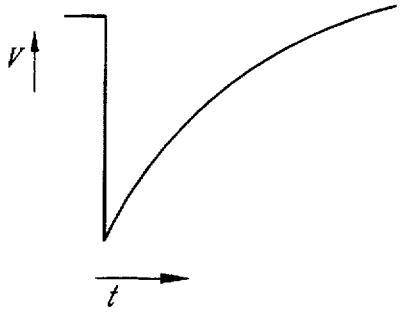
Figure 4A:
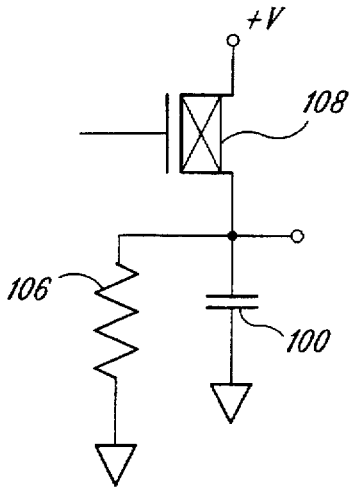
FIGS. 4A and 4B are a schematic and a waveform diagram, respectively, showing another approach to switching the voltages on the emitters and extraction grids of conventional field emitter displays.
Figure 4B:
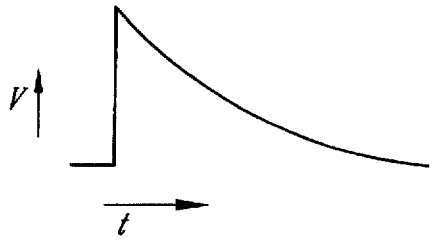
Figure 5:
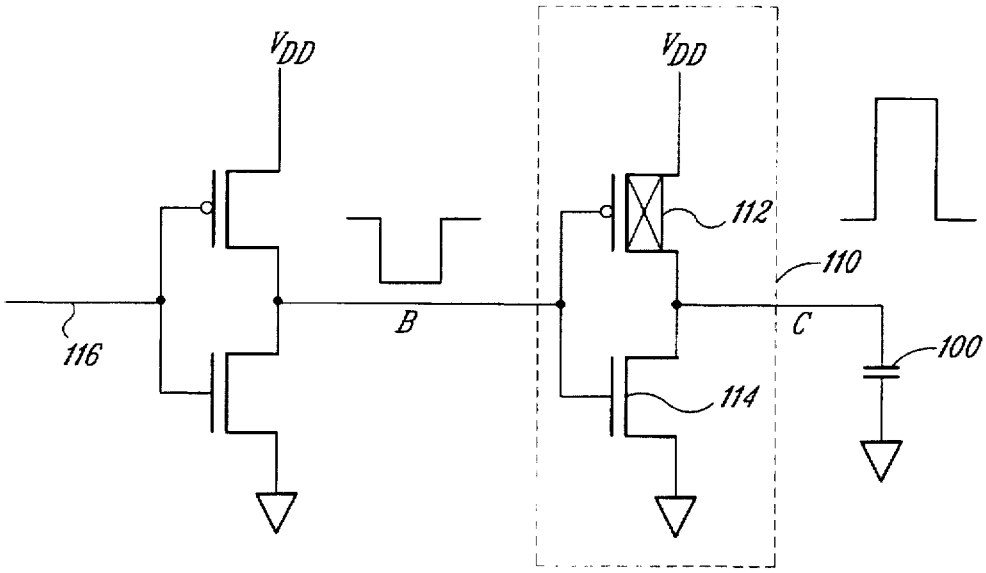
FIG. 5 is a schematic of still another approach for switching the voltages on the emitters and emission grids of conventional field emitter displays.

As shown in FIG. 6A, an NTSC signal starts at time 180 with an analog video data portion 182 extending to time 184. The duration of the video data portion is, under the standards of the National Television Standards Committee, 53.2 microseconds. As shown in FIG. 6, the analog video signal is a positive wave form having an amplitude at any point in time corresponding to the intensity of a pixel or location along a row of a display. Following the end video signal 182 at time 184, a horizontal retrace signal 190 extends to time 192. The horizontal retrace signal 190 includes a negative going pulse 196 which causes the scan of the display to retrace to a subsequent line or row. As explained in detail below, the preferred embodiment of the invention periodically samples the video signal 182 of the NTSC signal to provide a set of samples, each of which corresponds to the intensity of light emitted by electrons flowing from an emitter or set of emitters to the anode. Each of the samples is then used as an input to a pulse width modulator for each column of interconnected emitters. As explained above with reference to FIG. 2, the duration that the emitter emits electrons to the anode is proportional to the intensity of the light emitted. The presently preferred embodiment of the invention utilizes NMOS transistors to drive the emitters and extraction grids low, as explained above with reference to FIG. 3. Thus, starting at time 184, the voltage on three columns of emitters, column A50, column B52 and Column C54, is at a relatively high voltage. At time 200, the emitters in column A50 are driven low and remain low for the duration of the horizontal retrace period. The voltage on all of the extraction grids connected to a selected row 60 are also at a relatively high voltage during the entire horizontal retrace period, as shown in FIG. 6. Thus, electrons flow from the emitter in column A50 that is common to the selected row 60 starting at time 200. The light emitted by the selected emitter in column A50 will thus be relatively bright. In contrast, the emitters in column B52 are not driven low until time 202 which is midway through the horizontal retrace period 190. Thus, electrons do not flow from the emitter in column B52 that is common to the selected row 60 until time 202. The light emitted by the emitter in column B will thus be of moderate brightness. Finally, the emitters in column C54 are not driven low until time 204 which is almost the end of the horizontal retrace period 190. Thus, electrons will not flow from the selected emitter in column C54 to the anode until time 204. The light emitted by the anode opposite the selected emitter in column C54 will thus be relatively dim. At the end of the horizontal retrace period, the extraction grids in the selected row 60 are driven to a relatively low voltage, as illustrated in FIG. 6. When the extraction grids are driven low, the voltage differential between the emitters in that row and their respective extraction grids are insufficient to cause the emitters to emit electrons. Thus, the emission of electrons from all emitters terminates at the end of the horizontal retrace period 190 at time 192.

As mentioned above, the preferred embodiment of the invention uses a switching circuit that is capable of providing a relatively low impedance to ground thereby driving the voltages on the emitters and extraction grids low at a rapid rate, as illustrated in FIG. 6. However, in order to minimize power consumption and make the circuitry as compact as possible, the switching circuit is not capable of driving the voltages on the emitters and extraction grids high at a rapid rate. Thus, after the flow of electrons from the emitters has been terminated, the voltages on the emitters and extraction grids return to the relatively high voltages at a relatively slow rate, as also shown in FIG. 6. However, since the inventive technique does not attempt to drive the emitters to emission in real time during the video signal 182, the relatively slow return of the emitters and extraction grids to their relatively high voltages does not limit the performance of the preferred embodiment. Instead, during the video signal for the next row, the preferred embodiment need only retain samples of the video signal and need not drive the emitters to emission until the end of the video signal, i.e., the start of the horizontal retrace signal 190.

Figure 7:
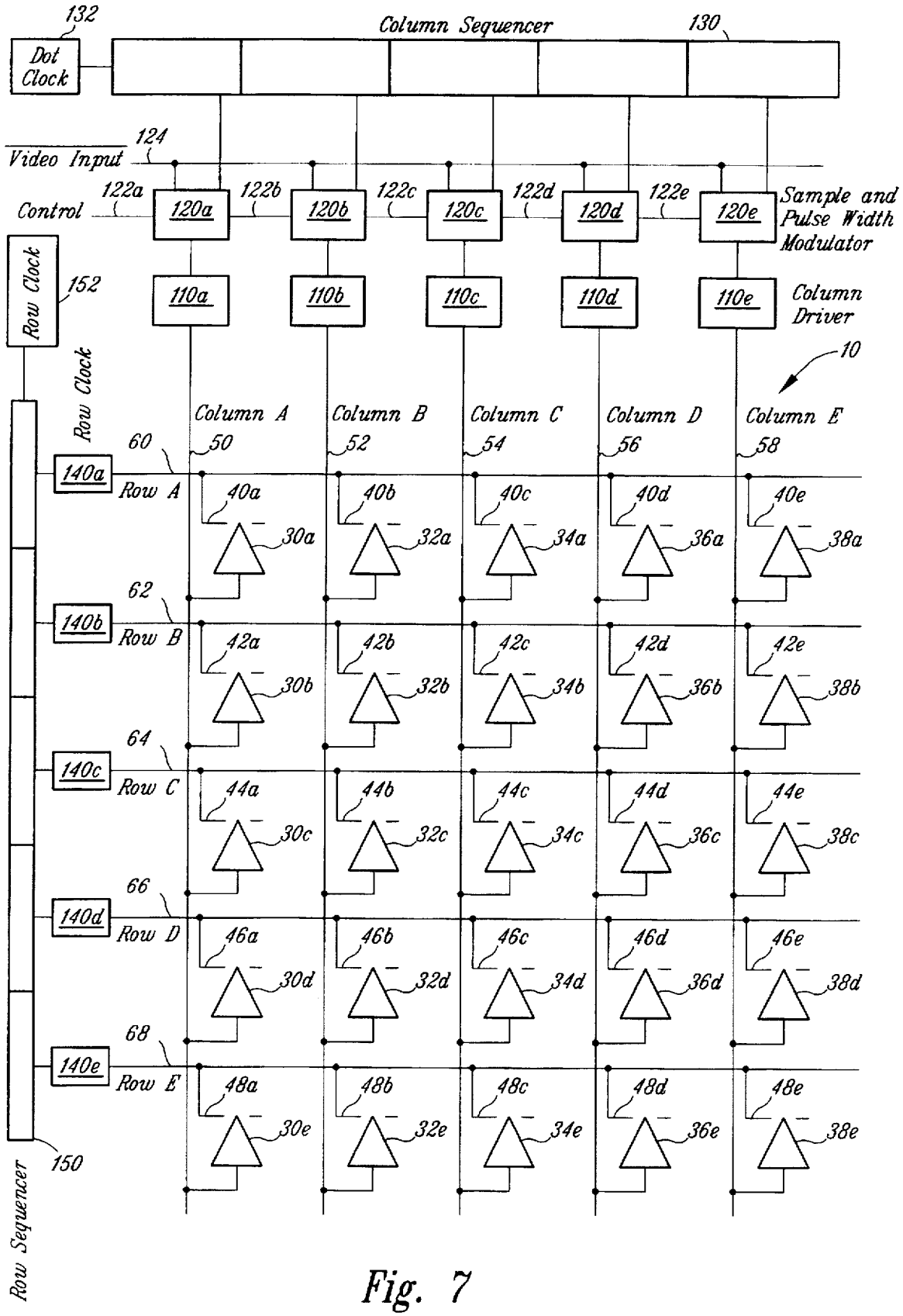
FIG. 7 is a schematic showing the presently preferred embodiment of the invention for providing gray scale modulation of a field emitter display.

A presently preferred embodiment of the invention operating in accordance with the waveforms shown in FIG. 6 is illustrated in FIG. 7. The embodiment of a matrix display shown in FIG. 7 is a field emission display 10, it will be understood that the invention is applicable to other types of matrix displays, such as plasma displays.

Figure 1:
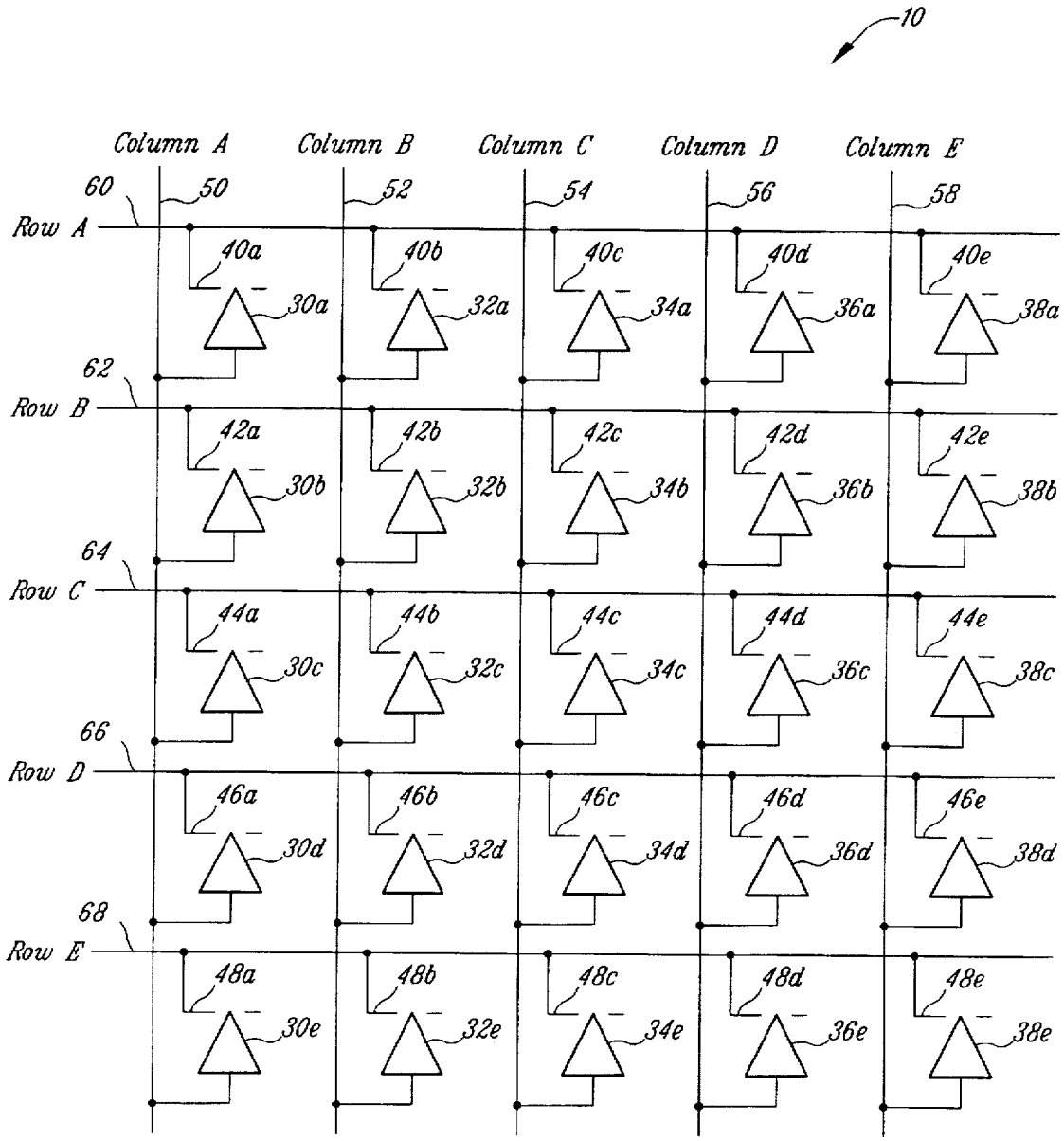
FIG. 1 is a schematic of a portion of a typical field emitter display.

As explained above with reference to FIG. 1, the field emission display 10 includes an array of emitters 30–38 and respective extraction grids 40–48. The field emission display 10 also includes an anode covered with a cathodoluminescent coating, although the anode has been omitted in FIG. 7 for purposes of clarity. The emitters in each column 50–58 are connected to each other and to a respective column driver 110*a–e*. Similarly, the extraction grids 40–48 in each row 60–68 are connected to each other and to a respective row driver 114*a–e*. Each of the column drivers 110 is driven by a respective sample and pulse with modulation circuit 120*a–e* which applies a pulse to its respective column driver 110 having the proper pulse width during the retrace signal portion of the NTSC signal. Each sample and pulse width modulation circuit 120 receives a control signal on a control input 122, the inverse of the NTSC signal on a video input 124 and an output from a column sequencer 130. The sequencer 130 is, in turn, driven by an oscillator 132 of conventional design outputting a square wave having a period of 53.2 microseconds divided by the number of columns. As explained below, the sequencer 130 causes the sample and pulse width modulator circuits 120 to sample the NTSC signal at the proper times.

The extraction grids 40–48 in each row 60–68 are connected to each other and to a respective row driver 140. The row drivers 140 are driven by respective outputs from a row sequencer 150 which is, in turn, driven by row clock pulses from a row clock oscillator 152. As explained below, the purpose of the row sequencer 150 is to sequentially enable each of the rows 60–68 after the receipt and processing of each NTSC signal.

In operation, the row sequencer 150 initially enables the row driver 140*a* for the first row 60. The dot clock 132 then causes the sequencer 130 to output a sample pulse at each of its outputs in sequence from the left output to the right output. Although only five column sequencer outputs are shown, it will be understood that, in practice, hundreds or even thousands of outputs will be applied to corresponding sample and pulse width modulator circuits 120. Regardless of the number of outputs from the column sequencer 130, the timing of the sequencer 130 is such that a sample pulse will be generated from the left most output at the start of the video signal portion of the NTSC signal, and a sample pulse will be generated at the right most output from the sequencer 130 at the end of the video signal portion of the NTSC signal. Sample pulses are preferably generated at the other outputs of the column sequencer 130 at equally spaced times. Thus, at the end of the video signal portion of the NTSC signal, a respective sequentially obtained sample will be stored in each of the sample and pulse width modulator circuits 120*a–e*.

After all of the samples have been obtained, the horizontal retrace signal portion of the NTSC signal occurs, as explained above with reference to FIG. 6. At the start of the horizontal retrace signal, the common control input 122 to all of the sample and pulse width modulator circuits 120*a–e* causes the sample and pulse width modulator circuits 120*a–e* to generate a high to low voltage transition. The time of occurrence of the transition is proportional to the amplitude of the inverse of the NTSC signal. Thus, with reference to FIG. 6, if the inverse of the NTSC signal is relatively small, the high to low transition at column A50 will occur shortly after the start of the horizontal retrace period. Similarly, as explained above with reference to FIG. 6, if the inverse of the video input signal is relatively large (corresponding to a relatively small NTSC sample), then the high to low transition from the sample and pulse width modulator circuit 120 for column C54 will occur toward the end of the horizontal retrace portion. These high to low transitions are applied to the emitters of the field emission display 10 through respective column drivers 110 which, as explained in greater detail below, provide a relatively low impedance path to ground responsive to the high to low transition from its respective sample and pulse width modulator circuit 120. In response to a low to high transition from its respective sample and pulse width modulator circuit 120, the column driver 110 applies a relatively high voltage to the emitters through a relatively high impedance path. After the emitters in columns A–E have been pulse width modulated during the time that the row driver 140*a* for row A60 has driven row A60 high, the row clock 152 increments the row sequencer 150 to provide an output to the next row driver 140*b*. The extraction grids in row B62 are then driven high so that the emitters in columns A–E that are common to row B62 can emit electrons in accordance with the pulses from the respective column drivers 110*a–e*.

Figure 8:
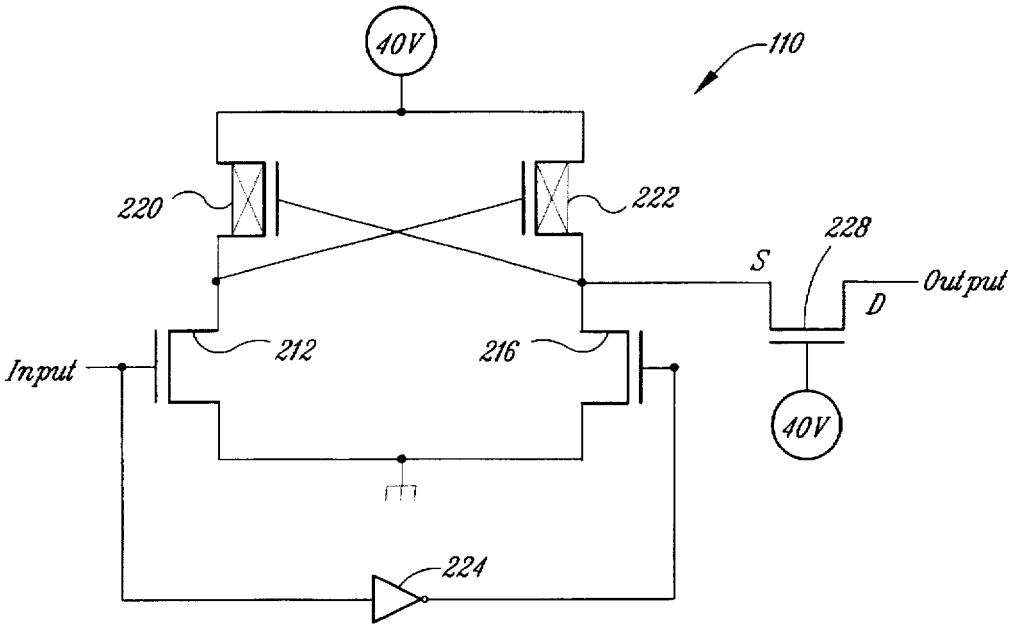
FIG. 8 is a schematic of a column driver used in the embodiment of FIG. 7.

One embodiment of a column driver 110 used in the embodiment of FIG. 7 is illustrated in FIG. 8. The column driver 110 receives an input from a respective sample and pulse width modulation circuit 120 at the gate of an NMOS transistor 212 and the input of an inverter 224. The output of the inverter 224 is applied to the gate of a second NMOS transistor 216. Thus, the transistors 212, 216 are alternately enabled by the input from the sample and pulse width modulation circuit 120. When the input is high, the transistor 212 is switched on and the transistor 216 is switched off. Alternately, when the input is low, the transistor 212 is switched off and the transistor 216 is switched on. The drains of the transistors 212, 216 are connected to a 40-volt supply through respective PMOS transistors 220, 222. It will be recalled that it is generally desirable to avoid using both NMOS transistors and PMOS transistors in the same circuit for the purpose of switching the voltages on emitters and extraction grids because of the need to use relatively wide channels for PMOS transistors. However, the PMOS transistors 220, 222 used in the column driver 110 function essentially as resistors and thus have a relatively narrow channel. The gates of the transistors 220, 222 are connected to the drains of the opposite switching transistors 216, 212, respectively. Thus, when the transistor 212 is switched on, a signal at approximately ground potential is applied to the gate of the transistor 222 thereby turning the transistor 222 on and driving the drain of the transistor 216 high. Alternately, when the transistor 212 is switched off and the transistor 216 is switched on, the transistor 220 is turned on and the transistor 222 is turned off, thereby driving the drain of the transistor 216 to ground potential. The drain of the transistor 216 is applied to a respective column of emitters through a NMOS transistor 228. The purpose of the NMOS transistor 228 is to isolate the transistors 216, 220 from the capacitive load of the emitters when the output switches from low to high, thereby allowing the transistor 220 to switch off quickly. If the transistor 228 was not present, the capacitive load would hold the gate of the transistor 220 low after transistor 212 turned on, thereby connecting the 40 volt supply to ground through the simultaneously on transistors 220, 212.

In operation, the inputs to the column drivers 110 are high during the entire video signal and the initial part of the horizontal retrace signal. Thus, the transistors 212, 222 are on and the transistors 216, 220 are off during the video signal portion of the NTSC signal. During this time, the 40 volt output on the drain of transistor 216 is applied to the source of the transistor 228 thereby turning transistor 228 off since the gate of the NMOS transistor 228 is biased at 40 volts. When the emitters are to be driven low, the input to the column driver 110 goes low, thereby turning off the transistors 212, 222 and turning on the transistors 216, 220. The low at the drain of the transistor 216 then turns on the transistor 228, thereby driving the emitters connected to the output low through a relatively low impedance. When the input goes high, a low is applied to the gate of the transistor 216 thereby turning off the NMOS transistor 216. At the same time, the high applied to the gate of transistor 212 turns on the transistor 212, thereby turning on the PMOS transistor 222 so that 40 volts are applied to the source of the NMOS transistor 228. The NMOS transistor 228 is then turned off to isolate the emitters from the gate of the PMOS transistor 220 as soon as the input goes high. As explained above, if the NMOS transistor 228 was not present, the gate of the PMOS transistor 220 would be held low for a considerable period until the voltage on the emitters returned to 40 volts. Under these circumstances, the PMOS transistor 220 would be on at the same time that the NMOS transistor 212 was on, thereby wasting considerable power. The column driver 110 thus quickly switches the voltage on the emitters to 0 volts, allowing the voltage on the emitters to return to 40 volts relatively slowly, and isolates the transistors 212, 216, 220, 222 from the emitters during this low to high transition.

Figure 9:
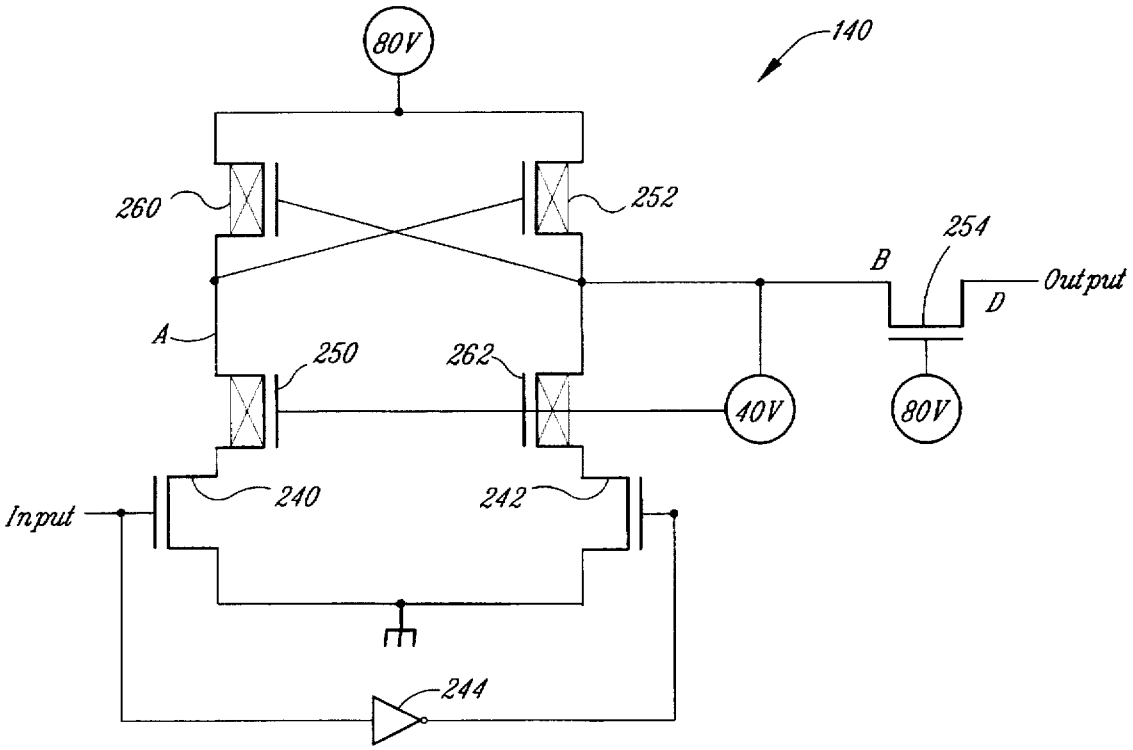
FIG. 9 is a schematic of a row driver used in the embodiment of FIG. 7.

The row drivers 140 shown in FIG. 9 operate in substantially the same manner as the column drivers 110 shown in FIG. 8 except that the output voltage is clamped at 40 volts so that it switches between 40 and 80 volts. When the input is high, a NMOS transistor 240 is turned on and a PMOS transistor 242 is turned off because of the inversion of the input by an inverter 244. When the NMOS transistor 240 turns on, a current is drawn through a PMOS transistor 250 until the voltage on the source of the PMOS transistor 250 reaches the gate bias voltage of 40 volts. The 40 volts on the source of the PMOS transistor 250 is applied to the gate of a PMOS transistor 252 thereby turning on transistor 252. The drain of the transistor 252 then rises to 80 volts thereby turning on an NMOS transistor 254 because of the 80 volt bias on its gate. Because of the relatively high impedance of the PMOS transistor 252, the voltage on the output rises relatively slowly until it reaches 80 volts. The 80 volts on the drain of the PMOS transistor 252 turns off the PMOS transistor 260. Although the PMOS transistor 262 is turned on at this time because of the 40 volts applied to its gate, no current flows through the PMOS transistor 262 because, as explained above, the NMOS transistor 242 is turned off.

When the input signal goes low, the NMOS transistor 240 turns off and the NMOS transistor 242 turns on. When the NMOS transistor 240 turns off, it discontinues drawing current through the PMOS transistor 250. At the same time, when the NMOS transistor 242 turns on, it draws current through the PMOS transistor 262 thereby causing the voltage on the source of the PMOS transistor 262 to drop. This reduced voltage turns on the PMOS transistor 260 thereby causing the gate of the PMOS transistor 252 to rise to 80 volts. The PMOS transistor 252 then turns off so that the PMOS transistor 262 and the NMOS transistor 242 do not provide a direct path from 80 volts to ground. The voltage on the source of the PMOS transistor 262 continues to drop because of the current pulled through the PMOS transistor 262 and the NMOS transistor 242 until approximately 40 volts is reached. The PMOS transistor 262 then starts to turn off because of the 40 volt bias on the gate of the transistor 262. The impedance of the PMOS transistor 262 and the NMOS transistor 242 is relatively low so that the voltage at the output quickly drops to 40 volts.

As in the column driver 110 of FIG. 8, the output NMOS transistor 254 in the row driver 140 isolates the gate of the PMOS transistor 260 from the output when the output is returning to 80 volts in order to prevent the PMOS transistor 260 from remaining on when the transistors 240, 250 are turned on. The row drivers 140 thus provide an output that quickly drops to 40 volts when the input goes low, slowly rises to 80 volts when the input goes high, and isolates the output from the transistors 240, 242, 250, 252, 260, 262 during the 40 volt to 80 volt transition of the output.

Figure 10:
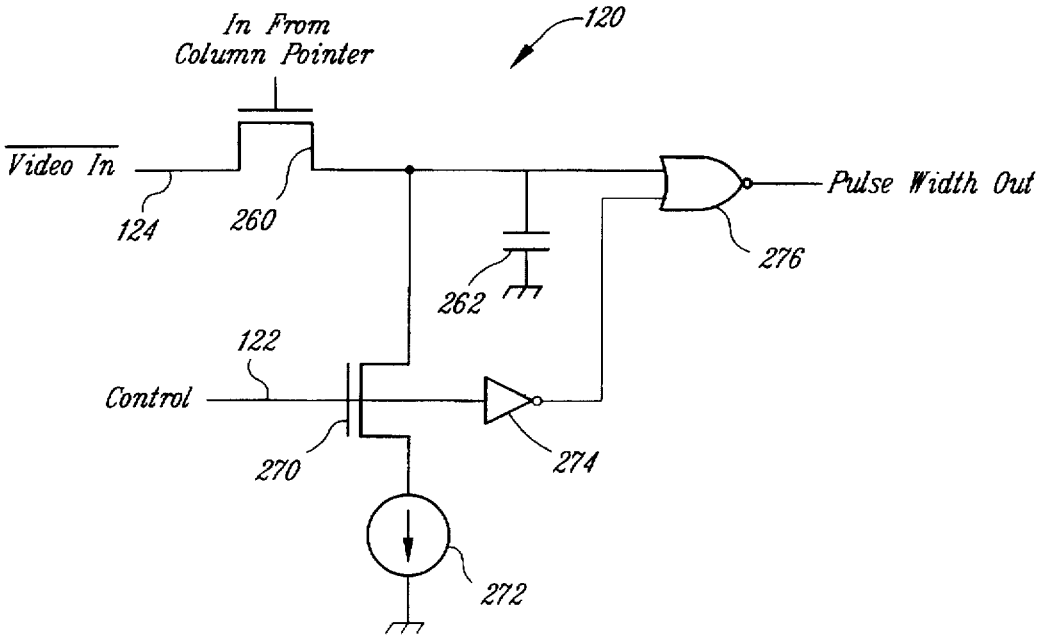
FIG. 10 is a schematic of a sampling and pulse width modulation circuit used in the preferred embodiment of FIG. 7.

The sample and pulse width modulation circuit 120 of FIG. 7 is illustrated in greater detail in FIG. 10. The inverse of the video signal 124 is applied through an NMOS transistor 260 to a capacitor 262 so that the capacitor 262 stores the voltage of the input signal 124 when the transistor 260 is closed at the appropriate time. The capacitor 262 thus stores a sample of the video signal at a time corresponding to the location of the column in the field emission display. It will be recalled from the explanation of FIG. 7 that the switching signal applied to the gate of the NMOS transistor 260 is generated by the column sequencer 130.

At the start of the horizontal retrace signal, the control signal 122 is applied to the gate of an NMOS transistor 270 to allow a conventional current sink 272 to draw current from the capacitor 262. The control signal 122 that turns on the NMOS transistor 270 is inverted by an inverter 274 and applied to one input of an OR gate 276. The OR gate 276 is thus enabled by the control signal 122. However, when the output of the inverter 274 goes low, the output of the OR gate 276 does not immediately go low because of the voltage on the capacitor 262. Instead, the voltage on the capacitor 262 does not fall to the switching voltage of the OR gate 276 until some time after the start of the horizontal retrace signal. The output of the OR gate 276 then goes low. The delay in the high to low transition at the output of the OR gate 276 is proportional to the voltage on the capacitor 262. The current sink 272 can draw current from the capacitor 262 for a longer period until reaching the switching voltage of the OR gate 276 if the voltage stored on the capacitor 262 is relatively large. Conversely, a lower voltage stored on the capacitor 262 causes the voltage applied to the OR gate 276 to more quickly reach the switching voltage. Since the input signal 124 is the inverse of the video signal shown in FIG. 6, a larger video signal results in a smaller delay and a smaller video signal results in a larger delay, as illustrated in FIG. 6. The sample and pulse width modulation circuit 120 thus samples the video signal portion of the NTSC signal at the appropriate time, and converts that sample to a positive going pulse during the horizontal retrace signal portion of the NTSC signal having a pulse width proportional to the amplitude of the sample of the inverse video signal.

Figure 11:
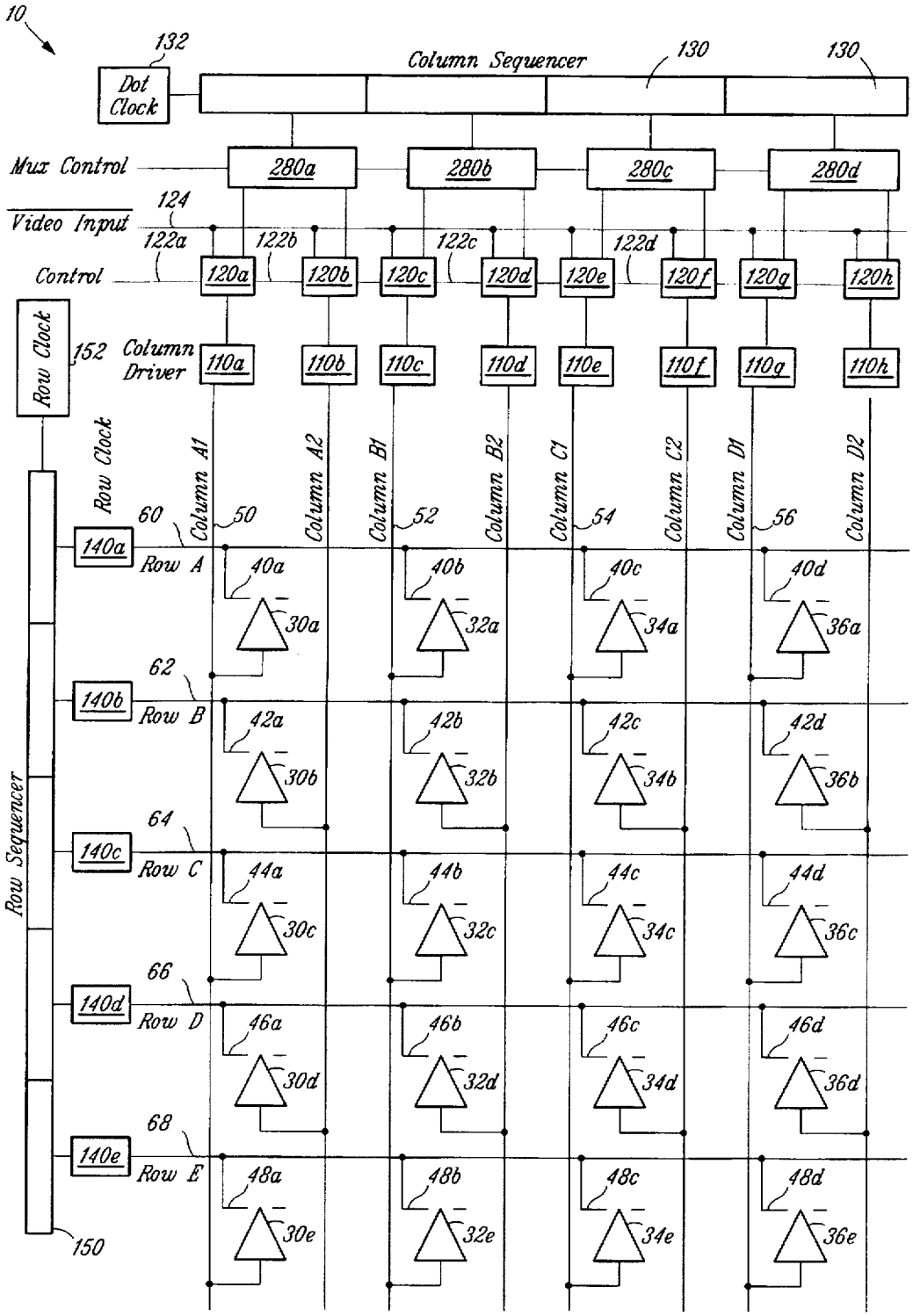
FIG. 11 is an alternative embodiment of the invention for providing gray scale modulation of a field emitter display.

An alternative embodiment of the field emission display is illustrated in FIG. 11. The embodiment of FIG. 11 is substantially identical to the embodiment of FIG. 7 and it contains most of the same components. Thus, in the interest of brevity, the explanation of these components will not be repeated. The embodiment of FIG. 11 differs from the embodiment of FIG. 7 in the inclusion of multiplexers 280 that direct alternate signals from the dot clock 130 to respective sample and pulse width modulation circuits 120. The sample and pulse width modulation circuits 120 apply their outputs to respective column drivers 110. The column drivers 110 connected to the same multiplexers 180 apply their outputs to the emitters in alternating rows. As a result, the emitters and the extraction grids can be driven so that the emitters emit electrons for a duration longer than the horizontal retrace signal portion of the NTSC signal. More specifically, for example, the emitter driven by the column driver 110*a* and the extraction grids in Row A60 driven by the row driver 140*a* can emit electrons during not only the horizontal retrace signal corresponding to that Row 60, but also during the period of time that the NTSC signal for the next row 62 is being received. This interleaving of the NTSC signal for alternate rows greatly increases the amount of time that an emitter can be made to emit electrons.

Figure 12:
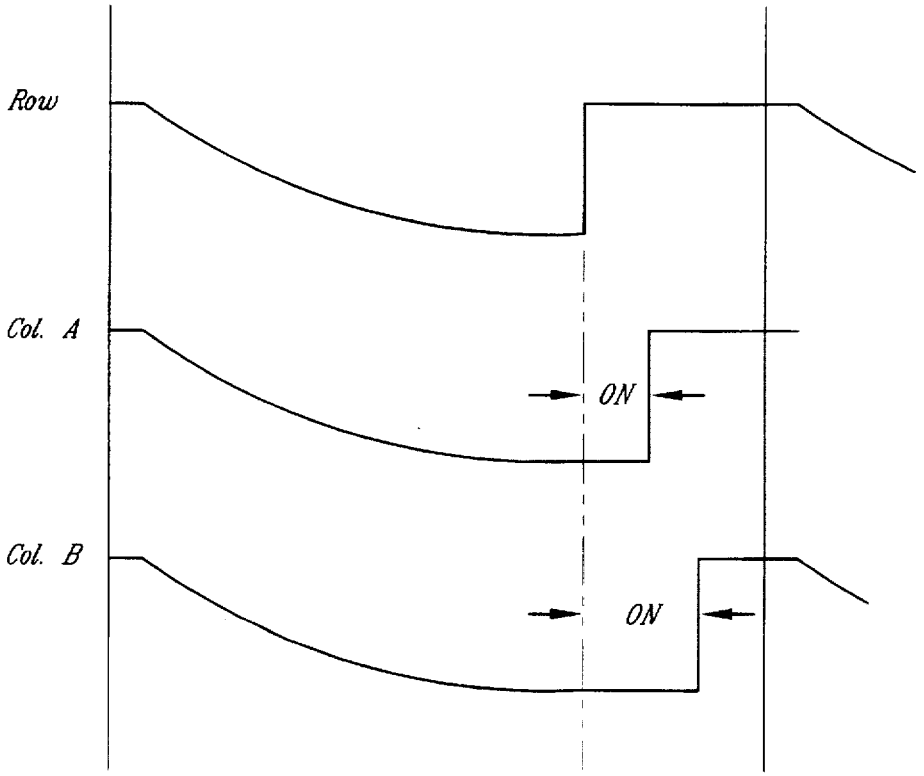
FIG. 12 are wave form diagrams showing alternative approaches to providing gray scale modulation of a field emitter display in accordance with the present invention.

As explained above with reference to FIG. 6, in the preferred embodiment of the invention the extraction grids in a row can be quickly driven high at the start of the horizontal retrace period while the voltage on the emitters of a column remain low, thereby causing the emitter to emit electrons. A predetermined time after the start of the horizontal retrace signal (depending upon the desired intensity of the emission), the emitters in the column can be quickly driven high to terminate the emission of electrons, as illustrated in FIG. 12. Operation in this manner requires some changes to the column drivers illustrated in FIG. 8 and row drivers illustrated in FIG. 9 which will be apparent to one skilled in the art. However, all of the basic topography remains the same. After the end of the horizontal retrace signal, the voltages on the extraction grids in a row and emitters in a column would slowly return to their relatively low values, as also illustrated in FIG. 12. Also, of course, the system can be altered so that the extraction grids in a row are pulse width modulated in the same manner as the emitters of a column are pulse width modulated in the systems illustrated in FIGS. 7 and 11. Similarly, the voltages on the emitters of each column can be switched at the beginning or end of the horizontal retrace signal in the same manner that the extraction grids in each row were switched in the embodiment of FIGS. 7 and 11. Thus, it will be evident to one skilled in the art that, although specific embodiments of the invention have been described herein for purposes of illustration, various modifications may be made without deviating from the spirit and scope of the invention.

I claim:

1. A system for providing gray scale modulation for a matrix display having a plurality of control inputs including a plurality of row inputs and a plurality of column inputs, said display having a plurality of localized display areas, a voltage differential between a selected column input and a selected row input enabling a corresponding display area of said display defined by respective overlaps between a row and a column, said modulation being provided from a video signal for each row of said display, said system comprising:

a sampling circuit receiving said video signal, said sampling circuit sampling the video signal to obtain a plurality of samples corresponding to the amplitude of the video signal at respective sample times;

a plurality of pulse width modulators each of which is connected to all of the emitters in a respective column, each of said pulse width modulators receiving a sample from said sampling circuit having a sample time corresponding to the location of said column in said display and generating a pulse width signal having a duration corresponding to the amplitude of said sample;

a plurality of column drivers each of which has an input connected to a respective pulse width modulator and an output connected to a respective column input of said display;

a plurality of row drivers each of which has an output connected to a respective row input; and a control circuit connected to said column drivers and said row drivers, said control circuit enabling a corresponding one of said column drivers for each sample of each of said video signals and enabling a corresponding one of said row drivers for each of said video signals, said row and column drivers being enabled to apply said voltage differential between each of said column inputs and one of said row inputs during a period after the end of a video signal and before the start of a subsequent video signal, said voltage differential having a duration corresponding to the duration of said pulse width signal whereby the duration of the period during which each of said display areas in said row is enabled corresponds to the amplitude of a respective sample.

2. The system of claim 1 wherein said row and column drivers are enabled by connecting the column input to a first relatively low voltage such that the difference between the voltage of the row input and the voltage of the column input is at least equal to a threshold voltage and disabled by connecting the row input to a second relatively low voltage such that the difference between the voltage of the row input and the voltage of the column input is less than the threshold voltage.

3. The system of claim 1 wherein said row and column drivers are enabled by connecting the row to a first relatively high voltage such that the difference between the voltage of the row input and the voltage of the column input is at least equal to a threshold voltage, and disabled by connecting the column input to a second relatively high voltage such that the difference between the voltage of the row input and the voltage of the column input is less than the threshold voltage.

4. The system of claim 1 wherein said sampling circuit comprises:

a column sequencer having a plurality of outputs each of which corresponds to one of said column inputs, said column sequencer sequentially generating a sample trigger pulse at each of its outputs after the end of said video signal, said column sequencer operating in synchronism with said video signal so that a set of trigger sample pulses are generated for each video signal; and a plurality of sample and hold circuits receiving said video signal, each of said sample and hold circuits corresponding to one of said column inputs and being connected to its respective column sequencer output, said sample and hold circuit storing a sample of said video signal upon receipt of a trigger sample pulse from said sequencer.

5. The system of claim 4 further including an interleaving control causing said column sequencer to generate a sample trigger pulse at alternating outputs during alternate video signals so that alternate video signals are sampled by each of said sample and hold circuits, said interleaving control further causing said pulse width modulators to generating a pulse width signal which may extend beyond the subsequent video signal.

6. The system of claim 4 wherein the sample stored in each of said sample and hold circuits is stored as a voltage on a capacitor, and wherein each of said pulse width modulator circuits comprises:

a current source;

a switch connecting said current source to said capacitor responsive to a control signal to draw current from said capacitor at a predetermined rate;

a comparator connected to said capacitor and to said control signal, said control signal enabling said comparator to allow said pulse width signal to be generated at an output of said comparator when the voltage on said capacitor reaches a predetermined value, said control signal disabling said comparator and terminating said pulse width signal whereby the duration of said pulse width signal is proportional to the magnitude of said sample.

7. The system of claim 1 further including an interleaving control causing said sampling circuit to sample alternate video signals and enabling the pulse width modulators for alternate column inputs during a period that may extend beyond the subsequent video signal.

8. The system of claim 1 wherein said matrix display comprises a field emission display having an anode, a plurality of emitters arranged in an array of rows and columns, and an extraction grid positioned adjacent each of said emitters for controlling the flow of electrons from said emitters to said anode as a function of the voltage differentials between said emitters and their respective extraction grids, all of the emitters in each column being connected to each other and to a respective column input, and all of the extraction grids in each row being connected to each other and to a respective row input.

9. The system of claim 1 wherein said video signal is part of an NTSC signal having a horizontal retrace signal following said video signal, and wherein said control circuit enables said column drivers and a row driver during the horizontal retrace signal of said NTSC signal.

10. A method of providing gray scale modulation for a matrix display having a plurality of row inputs and a plurality of column inputs, said display having a plurality of localized display areas, defined by respective overlaps between a row and a column, a voltage differential between a selected column input and a selected row input enabling a corresponding display area of said display, said modulation being provided from a video signal for each row of said display, said method comprising:

(a) sampling said video signal to obtain a plurality of samples corresponding to the amplitude of said video signal at respective sample times; said samples corresponding to respective locations of said display areas in a row;

(b) converting each of said samples to a corresponding pulse width;

(c) modulating the differential voltage between each of said column inputs and a row input with a voltage having a pulse width corresponding to its respective sample during said video signal; and (d) repeating steps (a)–(c) for each row of said display.

11. A method of providing gray scale modulation for a matrix display having a plurality of row inputs and a plurality of column inputs, said display having a plurality of localized display areas, defined by respective overlaps between a row and a column, a voltage differential between a selected column input and a selected row input enabling a corresponding display area of said display, said modulation being provided from a video signal for each row of said display, said method comprising:

(a) sampling said video signal to obtain a plurality of samples corresponding to the amplitude of said video signal at respective sample times; said samples corresponding to respective locations of said display areas in a row;

(b) converting each of said samples to a corresponding pulse width;

(c) modulating the differential voltage between each of said column inputs and a row input with a voltage having a pulse width corresponding to its respective sample during said video signal; and (d) repeating steps (a)–(c) for each row of said display wherein the differential voltage between each of said column inputs and a row input is modulated by the following steps:

maintaining the voltage on said row input at a relatively high voltage after the end of said video signal;

maintaining the voltage on said column input at a relatively high voltage after the end of said video signal, and then driving the voltage on said column inputs to a relatively low voltage a first predetermined time after the end of said video signal thereby enabling one of said display areas;

driving the voltage on said row input to a relatively low voltage a second predetermined time after the end of said video signal thereby disabling said display area, the duration of the period between said first predetermined time and said second predetermined time being a function of the duration of said pulse width; and allowing the voltages on said column input and row input to return to respective relatively high voltages during a subsequent video signal, the differential voltage between said column input and said row input being sufficiently small to substantially prevent said display area from being enabled during said video signal.

12. A method of providing gray scale modulation for a matrix display having a plurality of row inputs and a plurality of column inputs said display having a plurality of localized display areas, defined by respective overlaps between a row and a column, a voltage differential between a selected column input and a selected row input enabling a corresponding display area of said display, said modulation being provided from a video signal for each row of said display, said method comprising:

(a) sampling said video signal to obtain a plurality of samples corresponding to the amplitude of said video signal at respective sample times; said samples corresponding to respective locations of said display areas in a row;

(b) converting each of said samples to a corresponding pulse width;

(c) modulating the differential voltage between each of said column inputs and a row input with a voltage having a pulse width corresponding to its respective sample during said video signal; and (d) repeating steps (a)–(c) for each row of said display wherein the differential voltage between each of said column inputs and a row input is modulated by the following steps:

driving the voltage on said row input to a relatively high voltage a first predetermined time after the end of said video signal;

maintaining the voltage on said column at a relatively low voltage after the end of said video signal period thereby enabling a display area after said first predetermined time, and then driving the voltage on said column to a relatively high voltage a second predetermined time after the end of said video signal thereby disabling said display area, the duration of the period between said first predetermined time and said second predetermined time being a function of the duration of said pulse width; and allowing the voltages on said column input and row input to return to respective relatively low voltages during a subsequent video signal, the differential voltage between said column input and said row input being sufficiently small to substantially prevent the enabling of a display area during said video signal.

13. The method of claim 11 wherein the sampling of said video signal further includes the step of sampling alternate video signals to obtain a plurality of samples corresponding to respective locations of display areas in alternate rows, and wherein said step of modulating the differential voltage between each of said column inputs and a row input includes the step of modulating said differential voltage for alternate columns during a period extending beyond a subsequent video signal.

14. The method of claim 11 wherein said video signal is part of an NTSC signal having a horizontal retrace signal following said video signal, and wherein said differential voltage is modulated during the horizontal retrace signal of said NTSC signal.

15. The method of claim 12 wherein the sampling of said video signal further includes the step of sampling alternate video signals to obtain a plurality of samples corresponding to respective locations of display areas in alternate rows, and wherein said step of modulating the differential voltage between each of said column inputs and a row input includes the step of modulating said differential voltage for alternate columns during a period extending beyond a subsequent video signal.

16. The method of claim 12 wherein said video signal is part of an NTSC signal having a horizontal retrace signal following said video signal, and wherein said differential voltage is modulated during the horizontal retrace signal of said NTSC signal.

* * * * *

UNITED STATES PATENT AND TRADEMARK OFFICE

CERTIFICATE OF CORRECTION

PATENT NO. : 5,767,823
DATED : June 16, 1998
INVENTOR(S) : Hush

It is certified that error appears in the above-identified patent and that said Letters Patent is hereby corrected as shown below:

| | Reads | Should Read |
|---|---|---|
| Column 12, line 63 | "row to " | - - row input to - - |
| Column 14, line 18 | "sample during said video signal; and" | - - sample after an end of said video signal and before a start of a subsequent video signal; and -- |

Signed and Sealed this

Fifteenth Day of May, 2001

*Attest:*

Nicholas P. Godici

NICHOLAS P. GODICI

*Attesting Officer*

*Acting Director of the United States Patent and Trademark Office*